US005794360A

United States Patent [19]

Bell et al.

[11] Patent Number: 5,794,360

[45] Date of Patent: Aug. 18, 1998

[54] NON-SLIP SANDAL FOR USE ON OTHER FOOTWEAR AND HAVING STRAPPING MEANS FOR ENABLING TIGHTNESS ADJUSTMENT AND RAPID DISCONNECTION

[75] Inventors: Michael Bell, 1706 Triumphe Way, Warrington, Pa. 18976; Jonathan Marc Bell, Philapelphia, Pa.

[73] Assignee: Michael Bell, Warrington, Pa.

[21] Appl. No.: 814,767

[22] Filed: Mar. 7, 1997

[51] Int. Cl.[6] ..... A43B 3/12; A43B 3/18; A43C 11/08

[52] U.S. Cl. ..... 36/7.6; 36/7.7; 36/11.5; 36/50.1; 24/306; 24/685 K

[58] Field of Search ..... 24/302, 306, 713, 24/685 K; 36/7.5, 7.6, 7.7, 7.8, 11.5, 50.1, 62, 61

[56] References Cited

U.S. PATENT DOCUMENTS

| | | | |
|---|---|---|---|
| 131,318 | 2/1872 | Levin . | |
| 1,032,600 | 7/1912 | Grout . | |
| 2,361,972 | 11/1944 | Smith . | |
| 2,801,478 | 8/1957 | Gilbert . | |
| 2,925,672 | 2/1960 | Trovato | 36/50.1 |
| 3,205,544 | 9/1965 | Streule et al. | 36/50.1 |
| 3,214,850 | 11/1965 | McNair . | |
| 3,516,181 | 6/1970 | Jordon . | |
| 3,951,407 | 4/1976 | Calacurcio | 36/62 |
| 4,296,558 | 10/1981 | Antonious | 36/50.1 |
| 4,308,672 | 1/1982 | Antonious | 36/50.1 |
| 4,344,238 | 8/1982 | Peyser . | |
| 4,353,172 | 10/1982 | Bryant . | |
| 4,525,939 | 7/1985 | McNeil et al. . | |
| 4,793,075 | 12/1988 | Thatcher | 36/50.1 |
| 4,817,302 | 4/1989 | Saltsman . | |
| 4,869,000 | 9/1989 | York, Jr. . | |
| 4,910,883 | 3/1990 | Zock, Jr. . | |
| 4,920,664 | 5/1990 | McGregor et al. . | |
| 5,533,277 | 7/1996 | Bell et al. . | |

FOREIGN PATENT DOCUMENTS

| | | | |
|---|---|---|---|
| 1111959 | 3/1956 | France | 36/11.5 |
| 1125203 | 10/1956 | France | 36/7.5 |
| 48836 | 1/1931 | Norway | 36/62 |

*Primary Examiner*—Paul T. Sewell
*Assistant Examiner*—Anthony Stashick
*Attorney, Agent, or Firm*—Caesar, Rivise, Bernstein, Cohen & Pokotilow, Ltd.

[57] ABSTRACT

A strapping assembly for ice-gripping sandal or other device which is arranged readily adjust the tightness of its connection, while enabling its rapid and easy disconnection and reconnection. The strapping assembly includes a first end strap, a bridging strap member, and a second end strap. The first end strap is secured to one side of the sole of the sandal and has a free end portion to which a ring is secured. The second end strap is fixedly secured to the other side of the sole of the sandal and has a free end portion on which a VELCRO® strip is mounted. The bridging strap includes a VELCRO® strip on one end for releasable securement to the VELCRO® strip on the second end strap to secure the bridging strap thereto. The other end of the bridging strap then becomes it free end and is arranged to be extended through the ring and secured in place by other VELCRO® strips. The connection between the first end strap and bridging strap can be readily disconnected and can be readily reconnected.

10 Claims, 1 Drawing Sheet

NON-SLIP SANDAL FOR USE ON OTHER FOOTWEAR AND HAVING STRAPPING MEANS FOR ENABLING TIGHTNESS ADJUSTMENT AND RAPID DISCONNECTION

BACKGROUND OF THE INVENTION

This application relates generally to footwear and more particularly to attachments in the form of a sandal which is adapted to be worn over other footwear to provide resistance to slippage on ice or snow and which include a strapping assembly allowing for easy adjustment and rapid disconnection.

Various ice gripping, sandal-like, attachments for footwear are commercially and have been disclosed in the patent literature. Examples of such patented devices are found in the following U.S. Pat. Nos.: 1,032,600 (Grout); 2,361,972 (Smith); 3,214,850 (McNair); 3,516,181 (Jordan); 4,344,238 (Peyser); 4,353,172 (Bryant); 4,525,939 (McNeil et al.); and 4,910,883 (Zock, Jr.). While the devices disclosed in those patents appear generally suitable for their intended purposes, they still leave something to be desired from various standpoints, such as simplicity of construction, ease of mounting, removing, and adjusting. One of the most significant drawbacks of such devices is that their strapping systems for attaching the sandals to the primary footwear are relatively complex and cumbersome to operate. This is particularly true when the user is wearing heavy gloves or mittens (as is typically the case when such sandals are used in their intended environment outdoors on ice or snow). This drawback can prove to be hazardous if the wearer has to remove the sandal quickly in the interests of safety and if the strapping system is cumbersome to operate.

Various sandals with means for enabling the adjustment of their mounting straps have been disclosed in the patent literature, such as the following U.S. Pat. Nos.: Des. 131,318 (Levin); 2,801,478 (Gilbert); 4,817,302 (Saltsman); 4,869,000 (York); and 4,920,664 (McGregor et al.). However, none of these sandals discloses a strapping arrangement which enables ready adjustment to accommodate various size primary footwear and which includes quick release means for enabling the strapping system to be released by merely pulling thereon to enable the wearer to readily disconnect the sandal from the primary footwear when wearing heavy gloves or mittens.

OBJECTS OF THE INVENTION

Accordingly, it is a general object of this invention to provide a sandal which overcomes the disadvantages of the prior art.

It is another object of this invention to provide a sandal having mounting straps constructed so that the sandal can be easily mounted onto the sole of any type of primary footwear, can be readily adjusted to the size thereof, and can be rapidly and easily disconnected therefrom by simply pulling on a portion thereof.

It is yet another object of this invention to provide a sandal having a heel mounting strap assembly which is simple in construction.

SUMMARY OF THE INVENTION

These and other objects of this invention are achieved by providing a readily adjustable, quick disconnectable strapping assembly for releasably securing one component, e.g., a non-slip sandal, onto some body, e.g., a shoe or boot, or structure.

In accordance with one embodiment of the invention the strapping assembly forms a portion of a sandal is arranged for attachment to the sole of a primary footwear to provide a desired gripping function. The sandal comprises a sole member having a pair of sides, a front end portion and a rear end portion. The strapping assembly is secured to the sole for attaching the sandal to the primary footwear.

The strapping assembly comprises a first strap member, a second strap member, and a third strap member. The first strap member is fixedly secured to one of the sides of the sole adjacent the rear end and has a free end portion to which a ring is secured. The second strap member is fixedly secured to the other side of the sole adjacent the rear end and has a free end portion to which first releasable securement means is fixedly secured. The third strap is an elongated member having a first free end and a second free end. The first free end of the third strap includes second releasable securement means fixedly secured thereto. The second releasable securement means is arranged to be releasably secured to the first releasable securement means of the first strap. The second free end of the third strap is arranged to be extended through the ring at the free end of the first strap and brought into engagement with a portion of the third strap intermediate the first and second free ends to releasably secure the second free end thereto. The releasable securement between the first and second strap is arranged to be readily disconnected by merely pulling on the first free end of the third strap.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
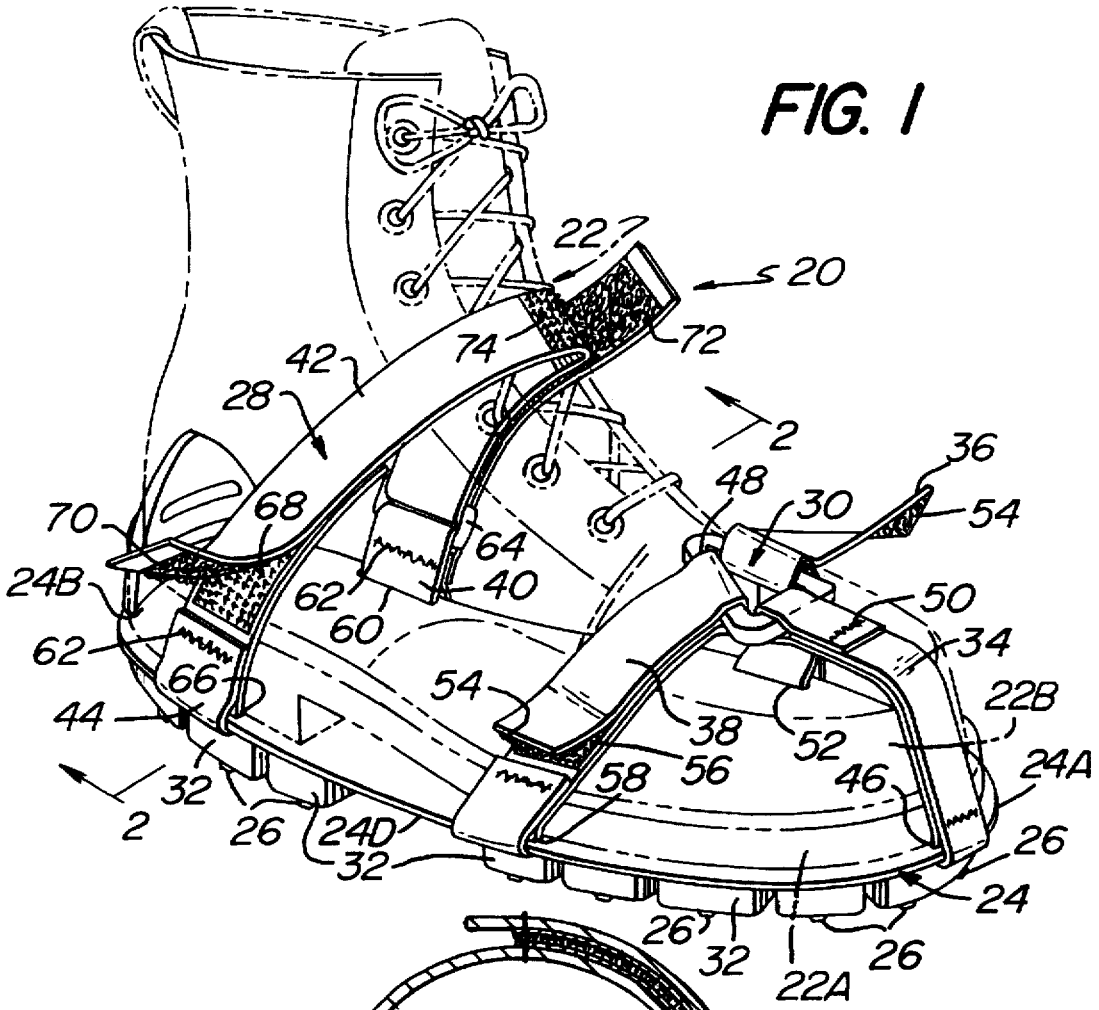
FIG. 1 is an isometric view of a sandal constructed in accordance with this invention and shown mounted on a conventional item of footwear, e.g., a boot, shown in phantom.
Figure 2:
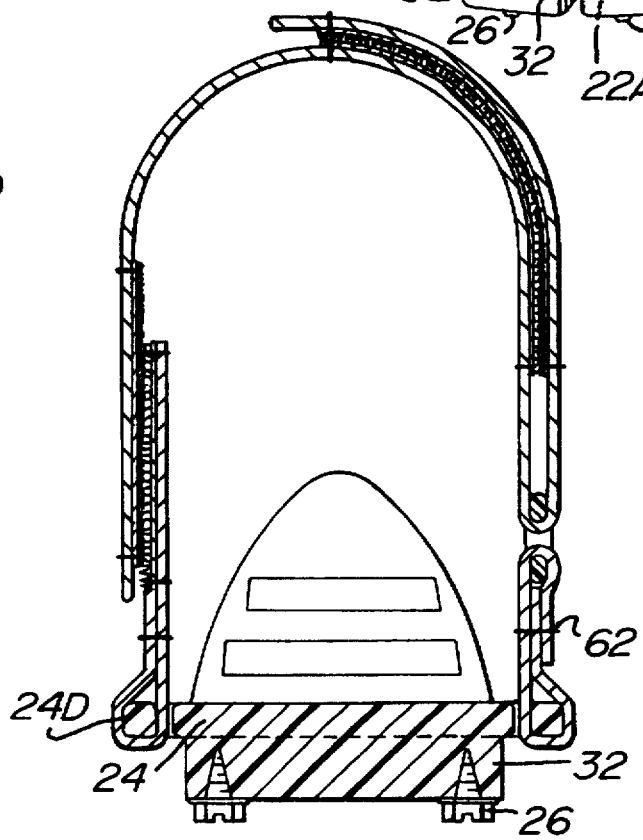
FIG. 2 is an enlarged sectional view taken along line 2—2 of FIG. 1.

Referring now to various figures of the drawing where like reference numerals refer to like parts there is shown at 20 in FIG. 1, a sandal constructed in accordance with this invention for securement to any type of conventional footwear 22, e.g., a boot, having a sole 22A and an upper 22B, to render the it resistant to slippage on slippery surfaces. In accordance with one preferred embodiment of this invention the sandal is particularly suited for providing slip resistance on ice. To that end the sandal 20 basically comprises a sole 24, having plural ice gripping projections 26, a rear strap assembly 28 for securing the heel of the sandal to the heel portion of the boot 22, and front strap assembly 30 for securing the toe of the sandal to the boot.

The sole 24 and the front strap assembly are preferrably constructed in accordance with the teachings of our U.S. Pat. No. 5,533,277, whose disclosure is incorporated by reference herein. It should be pointed out at this juncture that the sole need not be constructed in accordance with that patent. Thus, it can be of any conventional or non-conventional type of construction of any suitable material, leather, rubber, plastic, etc. So too, the front or toe strapping assembly 30 can be of alternative constructions from that of our aforementioned patent.

The sole 24 of the sandal 20 includes a front end 24A, a rear end 24B, and a pair of sides, namely, a medial side 24C and a lateral side 24D. The sides 24C and 24D are located on opposite sides of the sole's longitudinal axis. The underside of the sandal's sole includes the heretofore mentioned ice gripping projections 26. These projections are secured, e.g. threadedly mounted, onto plural cleats 32 forming the underside of the sole 24 so that they are spread out over most of the expanse of the sole, except for its arch portion. The cleats 32 are disposed in one group of angularly oriented cleats in the forefoot region and one group of transversely extending cleats in the heel region. The projections 26 are of any conventional construction, e.g., metal screws, having a head portion arranged to penetrate into the ice to grip it.

The toe strap assembly 30 and the heel strap assembly 28 each comprise plural, elongated, flexible strap members which are secured to the sole 24 and which cooperate with one another to enable the sandal 20 to be mounted on the boot 22 so that the sole 26 of the sandal is disposed under the sole 22A of the boot 22 as shown in the drawings. As best seen in FIG. 1 the toe strap assembly 30 basically comprises three elongated flexible straps 34, 36, and 38. These straps are connected to the sandal's sole in the toe and forefoot regions. The heel strapping subassembly 28 comprises three elongated flexible straps 40, 42, and 44, two of which (to be described later) are connected to the sandal's sole in the heel region.

The strap 32 of the toe strapping assembly is in the form of a strip of fabric, e.g., nylon, formed into a loop extending through a tranversely disposed slot 46 in the tip of the sandal's sole 24. This fixedly secures the strap 34 to the sole 24. The strap is oriented so that it extends upwards and backwards from the tip of the sole generally parallel to the longitudinal axis of the sole. The opposite end of the strap 34 extends through a triangular shaped ring 48. The ring is fixedly secured at the free end of the strap by a stitch line 50. The ring is formed of any suitable material, e.g., plastic, metal, etc.

The strap 36 is a in the form of a strip of the same material as the strap 34 and is fixedly secured to the sole 24 via a slot 52 extending in the medial side 24C of the sole in the forefoot-arch region. In particular, the lower end of the strip 36 extends through the slot 52 and is folded back on itself and is secured in place by a stitch line 50 (not shown). The strap 36 is oriented so that it extends at an acute angle, e.g., approximately 45 degrees, to the longitudinal axis of the sole 24, and has a free end including a strip 54 of the loop component of a VELCRO® fastener mounted on the outer surface thereof. A cooperating strip 56 of the hook component of the VELCRO® fastener is mounted on the outer surface of the strap 36 toward the intermediate portion thereof. The free end of the strap 36 is arranged to be extended through the triangular opening in the ring 48 and folded back over itself so that the cooperating VELCRO® strips 54 and 56 releasably engage each other, thereby releasably securing the strap 36 to the strap 34.

The strap 38 of the toe strapping assembly is similarly constructed to the strap 36 and is fixedly secured to the sole 24 in a similar manner, i.e., its lower end extends through a longitudinal slot 58 on the lateral side 24D of the sole and is folded over itself and secured in place by a stitch line 50. The strap 38 also is oriented so that it extends at an acute angle, e.g., approximately 45 degrees, to the longitudinal axis of the sole 24, whereupon its free end can be located adjacent the free end of the strap 36. Thus the free end of the strap 38 can be extended through the opening in the ring 48 and folded back over itself so that its cooperating VELCRO® strips releasably engage each other, thereby releasably securing the strap 38 to the straps 34 and 36. This action completes the formation of a "toe box" for the sandal.

The toe box serves to receive the toe portion of the primary footwear, e.g., the boot 22. Since each of the straps 36 and 38 is independently releasably secured to the ring 48, with the length of the strap being adjustable by merely folding over more or less of the free end portion thereof through the ring, the size and shape of the toe box can be adjusted to conform to the shape of the toe of the primary footwear. Moreover, the use of cooperating VELCRO® strips on the straps enables the size adjustment and securement to be accomplished quickly, easily and effectively.

The details of the rear strap assembly 28 for attaching the heel portion of the sandal 20 to the boot 22 will now be described. The heel strap assembly is constructed to enable it to be secured in place about the footwear and adjusted to a desired degree of conformity or tightness on the footwear, yet which can be quickly and easily disconnected. Moreover, the heel strap assembly can be readily reconnected without requiring any readjustment of the straps forming the assembly. To that end the heel strap assembly 28 basically comprises three straps, an end strap 40, a bridging strap 42, and another end strap 44. The end strap 40 is fixedly secured to the sandal's sole on the medial side 24C adjacent the-heel-arch region, while the other end strap 44 is fixedly secured to the sandal's sole on the lateral side 24D opposite from the strap 40. The bridging strap 42 is arranged to bridge and be releasably secured to the end straps 40 and 42 to complete the heel strap assembly 28.

The end strap 40 is an elongated strip of a fabric, like that forming any of the toe assembly straps. The bottom end of the strap 40 extends through a longitudinally extending slot 60 in the medial side 24C of the sandal's sole in the heel-arch region and is folded back over itself and secured in place via a stitch line 62. The free end of the end strap 40 extends upward from the sandal's sole and passes through an elongated rectangular ring 64 formed of the same material as the triangular ring 48.

The end strap 44 is a strip of an elongated fabric, like that forming the strap 40, and whose bottom end extends through a longitudinally extending slot 66 in the medial side 24D of the sandal's sole in the heel-arch region. The bottom end of the end strap 44 is folded back over itself and secured in place via a stitch line 62. The upper or free end of the end strap 44 extends upward from the sandal's sole and includes on its outer surface a strip 68 of a hook component of a VELCRO® fastener fixedly secured thereto. This strip serves as means for releasably securing the bridging strap 42 to the end strap 44, via a cooperating strip 70 of the VELCRO® fastener (to be described) mounted on the strap 42. The bridging strap 42 is also an elongated strip of fabric, like that of the straps 40 and 44. The VELCRO® strip 70 is fixedly secured to the upper or top surface of the bridging strap 42 immediately adjacent one end thereof. Thus, to releasly secure the bridging strap 42 to the end strap 44, all that is required is to bring the loop component strip 70 of the VELCRO® fastener of the strap 42 into engagement with the hook component strip 68 of the VELCRO® fastener on the strap 44. When this has been accomplished the opposite end of the bridging strap 42 is free and available to be releasably secured to the ring 64 on the strap 40. To that end, the strap 42 is extended over the instep portion of the boot or primary footwear on which the sandal 20 is to be mounted, and its free end extended through the ring 64. The free end of the bridging strap 42 can then be pulled back to cause the strap 42 to closely and tightly conform to the boot 20, irrespective of the boot's size or shape. Once the desired degree of tightness has been achieved the free end of the bridging strap 42 is folded over itself and releasably secured in place by VELCRO® fastening means (to be described hereinafter). This completes the connection of the heel strap assembly 28. In particular, the opposite end of the bridging strap 42 from the end on which the VELCRO® strip 68 is located includes a loop component strip 72 of VELCRO® fastener fixedly secured on the upper surface of the strap 42. A cooperating hook component strip 74 of a VELCRO® fastener is fixedly secured on the upper surface of the bridging strap 42 at an intermediate location. Thus, when the free end of the bridging strap 42 is extended through the ring 64 and pulled back over itself to tighten the strap assembly 28 to the boot, the loop VELCRO® component strip 72 can be brought into engagement with a portion of the hook VELCRO® component strip 74 to thereby releasably secure the bridging strap 42 to the end strap 40 and thus maintain the tightness of the strap assembly 28.

Once the heel strap assembly is adjusted and connected to the desired degree of tightness/conformity, it can be quickly disconnected without requiring much dexterity. This factor is of considerable importance to enable the sandal to be quickly removed from the boot even if the worker is wearing heavy hand coverings, e.g., gloves or mittens, as is commonly the case when working in cold conditions, and without requiring that the worker remove his/her hand coverings. To that end all that is required is to grasp the end of the bridging strap 42 at the point of its releasable connection to the end strap 44 and peel it off of that strap, thus disconnecting the cooperating VELCRO® strips 60 and 70. The boot can then be slipped off of the sandal, e.g., the toe of the boot slipped out of the toe box without requiring the opening of the toe box or the disconnection between the bridging strap 42 and the end strap 40.

To remount the sandal on the boot, all that is required is to reconnect the bridging strap 42 to the side strap 44 by bringing the VELCRO® strip 70 on the strap 42 into engagement with the VELCRO® strip 68 on the strap 44 at is original position, an action which can be accomplished even if the wearer's hand is covered by a bulky glove or mitten. Thus, the heel strap assembly will be automatically reconnected at its original tightness setting.

It should be pointed out at this juncture that while the strapping assembly of this invention has been disclosed and described with reference to use on an ice-gripping sandal, such use is not exclusive. Thus, the subject strapping assembly can be used on any type of footwear attachment. In fact the strapping assembly can be used on other types of garments or devices which are arranged to be worn on the body of a person and adjusted to conform to a desired degree of tightness, yet which can be readily disconnected and then reconnected without having to readjust the tightness.

Without further elaboration the foregoing will so fully illustrate my invention that others may, by applying current or future knowledge, adapt the same for use under various conditions of service.

We claim:

1. A strapping assembly for releasably securing one component to another to adjust the tightness therebetween, while enabling the rapid and easy disconnection of said strapping assembly, said strapping assembly comprises a first strap member, a second strap member, and a third strap member, said first strap member being fixedly secured to one of said components and having a free end portion to which a ring is secured, said second strap member being fixedly secured to the other of said components and having a free end portion to which first releasable securement means is fixedly secured, said third strap member being an elongated flexible member having a first free end and a second free end, said first free end of said third strap including second releasable securement means fixedly secured thereto, said second releasable securement means being arranged to be releasably secured to said first releasable securement means of said first strap member, said second free end of said third strap member being arranged to be extended through said ring at said free end of said first strap member and brought into engagement with a portion of said third strap member intermediate said first and second free ends to releasably secure said second free end thereto, said releasable securement between said first and second strap members being arranged to be readily disconnected by merely pulling on said first free end of said third strap member.

2. The strapping assembly of claim 1 wherein said one component comprises one side of a footwear attachment, and wherein said other component comprises another side of the footwear attachment.

3. The strapping assembly of claim 2 wherein said footwear attachment comprises a slip prevention device for releasable mounting on the sole of a primary footwear.

4. The strapping assembly of 3 wherein said footwear attachment comprises a sandal having ice-gripping projections.

5. The strapping assembly of claim 1 wherein said first and second releasable securement means comprise cooperating components of a hook and loop fastening system.

6. The strapping assembly of claim 5 wherein said second free end portion of said third strap member includes one component of a hook and loop fastening system, and wherein said intermediate portion of said third strap member includes a cooperating component of said hook and loop fastening system to releasably secure said second free end portion of said third strap member to said intermediate portion of said third strap member.

7. A footwear attachment for releasable mounting on a primary footwear to provide slip resistance therefore, said attachment comprising a sole member having a pair of sides, and a strapping assembly for releasably securing said sole member to the primary footwear, said strapping assembly being adjustable to adjust the tightness thereof, while enabling the rapid and easy disconnection of said device from the primary footwear, said strapping assembly comprises a first strap member, a second strap member, and a third strap member, said first strap member being fixedly secured to one of said sides of said sole member and having a free end portion to which a ring is secured, said second strap member being fixedly secured to the other of said sides of said sole member and having a free end portion to which first releasable securement means is fixedly secured, said third strap member being an elongated flexible member having a first free end and a second free end, said first free end of said third strap including second releasable securement means fixedly secured thereto, said second releasable securement means being arranged to be releasably secured to said first releasable securement means of said first strap member, said second free end of said third strap member being arranged to be extended over a portion of the primary footwear, through said ring at said free end of said first strap member and into engagement with a portion of said third strap member intermediate said first and second free ends to releasably secure said second free end thereto, said releasable securement between said first and second strap members being arranged to be readily disconnected by merely pulling on said first free end of said third strap member.

8. The attachment of claim 7 wherein said attachment comprises a sandal.

9. The attachment of claim 7 wherein said first and second releasable securement means comprise cooperating components of a hook and loop fastening system.

10. The attachment of claim 9 wherein said second free end portion of said third strap member includes one component of a hook and loop fastening system, and wherein said intermediate portion of said third strap member includes a cooperating component of said hook and loop fastening system to releasably secure said second free end portion of said third strap member to said intermediate portion of said third strap member.

* * * * *